US005893416A

United States Patent [19]

Read

[11] Patent Number: 5,893,416

[45] Date of Patent: Apr. 13, 1999

[54] OIL WELL TREATMENT

[75] Inventor: Peter Arne Read, Dorchester, United Kingdom

[73] Assignee: AEA Technology plc, Didcot, United Kingdom

[21] Appl. No.: 08/980,440

[22] Filed: Nov. 28, 1997

Related U.S. Application Data

[63] Continuation of application No. 08/348,986, Nov. 28, 1994, abandoned.

[30] Foreign Application Priority Data

| | | | |
|---|---|---|---|
| Nov. 27, 1993 | [GB] | United Kingdom | 9324434 |
| May 27, 1994 | [GB] | United Kingdom | 9410702 |

[51] Int. Cl.[6] ..... E21B 37/06

[52] U.S. Cl. ..... 166/304; 166/310; 166/902; 166/228; 507/902

[58] Field of Search ..... 166/304, 310, 166/902, 278, 276, 228; 507/902

[56] References Cited

U.S. PATENT DOCUMENTS

| | | | |
|---|---|---|---|
| 2,352,805 | 7/1944 | Scheuermann et al. | 166/310 |
| 2,546,586 | 3/1951 | Cross . | |
| 2,760,584 | 8/1956 | Rohrback . | |
| 2,775,302 | 12/1956 | Kirkpatrick | 166/310 |
| 2,879,847 | 3/1959 | Irwin | 507/902 X |
| 3,072,192 | 1/1963 | Van Poollen | 166/279 |
| 3,199,591 | 8/1965 | Kepley | 166/42 |
| 3,531,409 | 9/1970 | Seffens . | |
| 3,676,363 | 7/1972 | Mosier | 166/902 X |
| 3,756,949 | 9/1973 | Schreurs | 507/244 |
| 4,291,763 | 9/1981 | Singer . | |
| 4,653,586 | 3/1987 | Skinner | 166/278 |
| 4,656,205 | 4/1987 | Walker . | |
| 4,660,645 | 4/1987 | Newlove et al. | 507/902 X |
| 4,670,166 | 6/1987 | McDougall et al. | 166/278 X |
| 4,779,679 | 10/1988 | Snavely . | |
| 4,787,455 | 11/1988 | Snavely . | |
| 4,986,354 | 1/1991 | Cantu . | |
| 5,150,753 | 9/1992 | Gaidry et al. | 166/278 X |

FOREIGN PATENT DOCUMENTS

| | | |
|---|---|---|
| 0193369 | 9/1986 | European Pat. Off. . |
| 0416908 | 3/1991 | European Pat. Off. . |
| 543358 | 5/1993 | European Pat. Off. . |
| 1799893 | 3/1993 | U.S.S.R. . |
| 1290554 | 9/1972 | United Kingdom . |
| 2215367 | 9/1989 | United Kingdom . |
| WO 85/02443 | 6/1985 | WIPO . |
| WO 93/22537 | 11/1993 | WIPO . |

OTHER PUBLICATIONS

Derwent Publications Ltd., Abstract of SU 1,799,893.

*Primary Examiner*—Hoang C. Dang
*Attorney, Agent, or Firm*—William H. Holt; William R. Hinds

[57] ABSTRACT

Corrosion, scale-formation, or other deleterious processes are inhibited in an oil well by installing within the oil well (10) fluid-permeable elements, such as tubular filters (20), which comprises a suppressing material. Each filter (20) comprises two tubular filter screens (24) between which is a bed (26) of particles comprising suitable inhibitor material. The particles might for example be porous ceramic spheres impregnated with the inhibitor material. The inhibitor material gradually dissolves in the well fluids during operation, and may for example inhibit corrosion and/or scale formation.

11 Claims, 1 Drawing Sheet

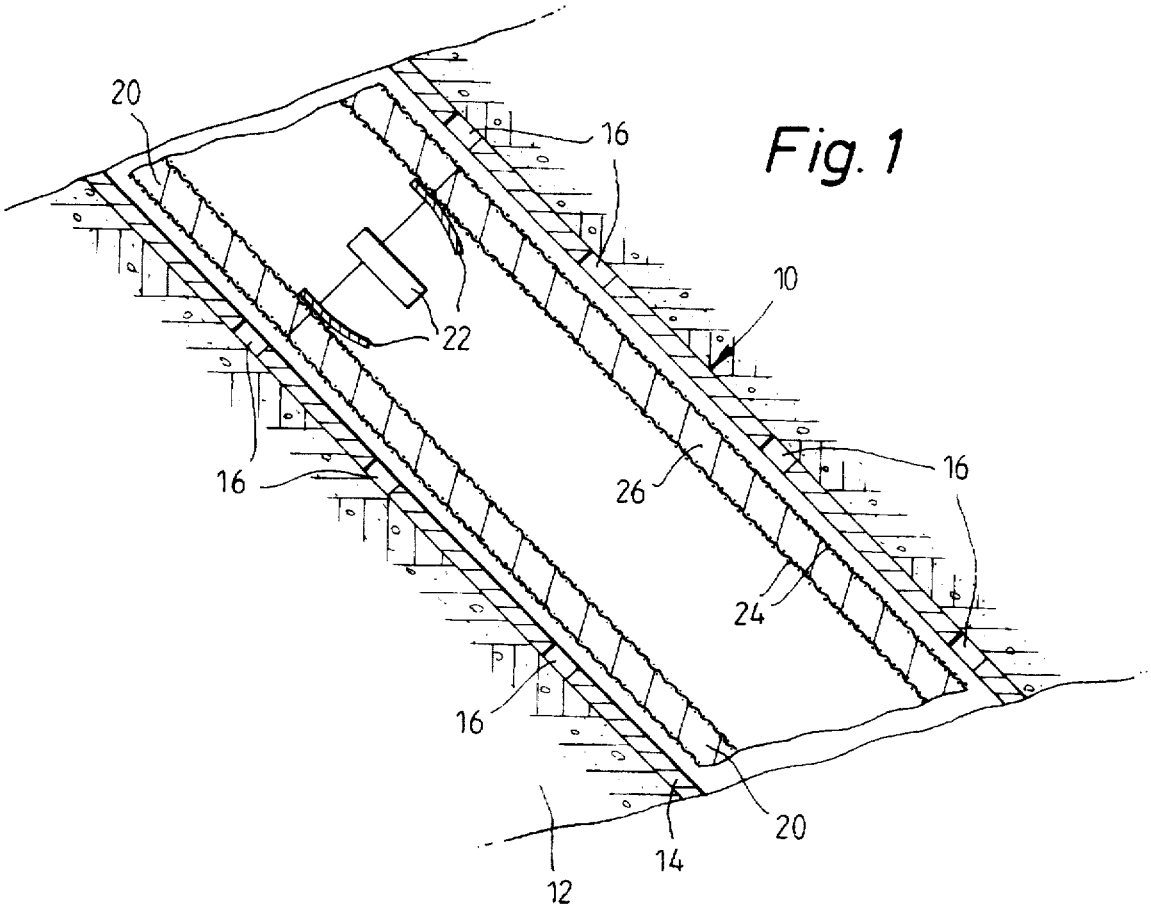
Fig. 1
Fig. 2
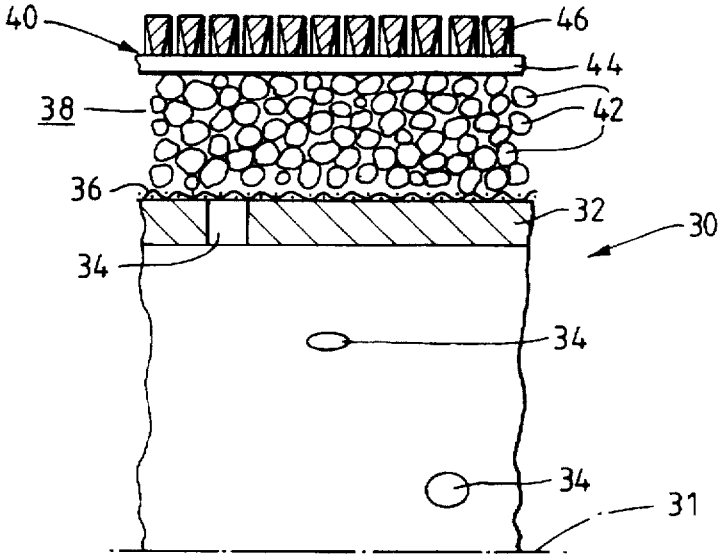

OIL WELL TREATMENT

This application is a continuation of application Ser. No. 08/348,986, filed Nov. 28, 1994, now abandoned.

This invention relates to a method for treating an oil well so as to inhibit scale formation, corrosion and/or other deleterious processes, and to an apparatus for performing this method.

For many oil wells the composition of the fluid or fluids in or adjacent to the well is such that it is beneficial to add to the fluid a material to inhibit deleterious properties which the fluid would otherwise exhibit. For example the fluids may be corrosive to the well casing so a corrosion inhibitor would be added; the fluids might form solid hydrates, or emulsions, for which suitable inhibitors might be added; or the fluids might form scale deposits, so a scale inhibitor would be added. The principal constituents or scales are carbonates or sulphates of calcium, barium or strontium, and such scale materials may precipitate as a result of changes in pressure or temperature of produced fluids, or when connate water mixes with injected water during secondary recovery operations. A variety of scale inhibitors are known. For example U.S. Pat. No. 4,590,996 describes the use of sodium salts of polyalkoxy sulphates, which are said to be effective at inhibiting barium sulphate scale formation. GB 2 248 832 describes the use of certain polyaminomethylene phosphonates as scale inhibitors; GB 2 250 738 describes the use of polyvinyl sulphonate of molecular weight above 9000 as a scale inhibitor; U.S. Pat. No. 4,947,934 describes the use of a polyacrylate inhibitor and a polyvalent cation which form a water-soluble complex, the complex increasing retention of the inhibitor in the formation. However such injected inhibitors do suffer some disadvantages; and in the case of sloping or horizontal wells the known techniques of injection are difficult to apply successfully, partly because sand or other sediments tend to collect on the lower side of the bore, and because injected liquids flow into the rock strata preferentially in the regions nearest to the well-head.

According to the present invention there is provided a method for treating an oil well so as to inhibit deleterious processes, the method comprising installing within the oil well one or more fluid-permeable elements comprising material to suppress the deleterious processes.

In a preferred method each element is a tubular filter. Such a filter may comprises two generally coaxial tubular filter screens defining a region between them, the region containing a fluid-permeable bed of particles comprising the suppressing material. The particles may be bonded together to form a coherent, permeable, tubular element, in which case one or both of the filter screen might be omitted. Alternatively each element might be a rod, bar, or ring of porous material containing or comprising the suppressing material; a plurality of such elements might be spaced apart within an oil well by a support structure such as a tubular filter screen.

The invention also provides a fluid-permeable element comprising material to suppress the deleterious processes for use in the said method. One such element is a tubular filter, for example comprising two generally coaxial tubular filter screens defining a region between them, the region containing a fluid-permeable bed of particles comprising material to suppress the deleterious processes.

In the preferred method the suppressing material is an inhibitor material; the fluid-permeable element acts as a reservoir of inhibitor material, which gradually dissolves into the well fluids during operation. In an alternative method the suppressing material is an absorber material.

This absorbs material dissolved in the well fluids which would cause, trigger or aggravate the deleterious processes. For example the absorber might be an ion exchange material, which would absorb calcium, barium and strontium ions, to suppress scale formation. When the element is a tubular filter it can also act as a filter to prevent particles of solid material such as grains of sand from being carried into the bore along with the flow of fluid from the surrounding strata. It should be appreciated that the method of the invention may be combined with injection of inhibitor material into the rocks surrounding the well.

The inhibitor material might comprise scale inhibitor and/or corrosion inhibitor and/or other inhibitors. The particles might include pellets of inhibitor material, or pellets of inhibitor material mixed with a binder and an inert material such as chalk. However such pellets may change in size as the inhibitor material dissolves, so the tubular filter would become less effective as a sand filter.

A preferred filter contains particles of an insoluble porous material in which inhibitor material is absorbed. For example the particles might be of porous inorganic oxide or ceramic, or porous organic material, so the tubular filter is structurally unchanged as the inhibitor material dissolves. In particular the particles might be porous beads of silica- or alumina-based material of size in the range 0.3 mm to 5 mm, preferably between 0.5 and 2 mm, for example about 1 mm, which might be made by a sol-gel process. They may have a porosity of in the range 10% to 30%, for example about 20%. The filer might contain different types of particles, some of which might not incorporate any inhibitor material, for example sand grains. The particles in the bed might be bonded together, for example by a resin, to form a coherent but permeable layer, and such a layer may also incorporate reinforcing material such as glass fibres. The resulting coherent particulate layer may be strong enough to be used on its own, or with just one of the filter screens.

The invention is applicable in vertical, inclined and horizontal oil wells. Clearly the external diameter of the tubular filter must be less than the bore of the well, so the filters fit in the oil well; and their length might be for example in the range 3 m to 10 m, this being governed by considerations of convenience for handling, and the requirement to pass around any bends in the oil well. Preferably the tubular filters are of diameter just less than the bore of the oil well, so that they act as a lining for the borehole, and adjacent filters abut each other end-to-end; they may be provided with projecting clips or spigots to ensure alignment of adjacent tubular filters along the length of the well.

The invention will now be further described by way of example only, and with reference to the accompanying drawings, in which:

FIG. 1 shows a sectional view through part of an oil well incorporating tubular filters; and FIG. 2 shows a sectional view to a larger scale of an alternative tubular filter to that shown in FIG. 1.

Referring to FIG. 1 there is shown part of an inclined oil well 10 extending through an oil-bearing stratum 12. The oil well 10 is lined with steel pipe 14 through which are perforations 16. Within the pipe 14 are tubular filters 20 each of diameter 5 mm less than the bore of the pipe 14, arranged end to end, abutting each other (only parts of two filters 20 are shown). The lower end of each filter 20 is provided with a plurality of curved projecting fingers 22 which ensure adjacent filters 20 are aligned. Each filter 20 comprises two wire mesh cylinders 24, coaxial with each other so as to define an annular gap 26 between them of radial width 10 mm, and the gap 26 is filled with a bed of porous silica spheres each of diameter 1 mm. Some of the spheres are impregnated with scale inhibitor and the rest with corrosion inhibitor.

Such porous silica spheres might be made by the method described in GB 1 567 003, that is by dispersing solid primary particles of silica (produced by a vapour phase condensation method) in a liquid to form a sol, forming droplets of the sol, drying the droplets to form porous gel spheres, and heating the gel to form the porous ceramic spheres. For example silica powder produced by flame hydrolysis and consisting of primary particles of diameter 27 nm were added to water to give a concentration of 100 g/liter, rapidly stirred, and then 100 ml of 0.125M ammonium hydroxide added to a liter of mixture. This gave a sol in which there were aggregates of the primary particles, the aggregates being of diameter about 0.74 μm. If it is dried to form a gel the porosity may be 80%.

As described in GB 1 567 003, similar sols can be made from alumina powder produced by flame hydrolysis, or from flame hydrolysed titania. When dried, the resulting gels are porous. Furthermore the porosity remains high when the gel is heated to form a ceramic, as long as the temperature is not raised too high—in the case of the alumina gel it must not exceed about 1100° C. Such high porosity particles provide a large surface area onto which inhibitors can be absorbed.

An alternative method for making the porous spheres is that described in GB 2 170 189 B, in which an organic compound of the appropriate element (e.g. silicon) in dispersed form is hydrolysed, in the presence of a protective colloid. The protective colloid might for example be a polyvinyl alcohol, or a water-soluble cellulose ether. For example a mixture of 40 ml ethyl silicate and 20 ml n-hexanol was added as a thin stream to a stirred aqueous ammoniacal solution of polyvinyl alcohol (50 ml of 5 percent by weight polyvinyl alcohol and 200 ml of 0.880 ammonia) and stirred for half an hour. Small droplets of organic material are dispersed in the aqueous solution, and gel due to hydrolysis. The mixture was then poured into 1 liter of distilled water and left to settle overnight. The supernatant liquid was decanted, the residue re-slurried in 500 ml of distilled water, and steam passed into it for an hour. The suspension was then filtered. The product was microspheroidal silica gel particles smaller than 90 μm.

It will be understood that a variety of different materials can be used for the particles, and that in a single tubular filter 20 there might be a variety of different particles. The particles might be of non-spherical shapes, for example they might comprise angular chips of silica gel; or they might comprise hollow fibres, for example glass fibres, with a inhibitor material precipitated or otherwise impregnated into their bore. Furthermore some or all of the particles might be of non-porous material.

EXAMPLE

A method of making porous particles in the form of round-ended cylindrical beads suitable for use in the tubular filter 20 is as follows:

(i) Ball clay (500 g of dry clay) is dispersed in 12 liters of water, then 4500 g of flame-hydrolysed silica powder is suspended in the dispersion, and water added to give a total volume of 15 liters. The suspension is spray-dried by disc atomisation to produce a gel powder with particles about 5 μm to 25 μm in diameter.

(ii) A mixture is made of 630 g of the gel powder of stage (i), with 70 g of dry ball clay, 630 g of water, and 300 g of starch (PH101 Avicel); this mixture has the requisite rheology for extrusion, and the added clay gives stronger beads. The mixture is extruded through a profile screen, and the extruded lengths are spheronised (in a NICA Spheroniser S 320) to give cylindrical shapes with rounded ends. These shaped beads are dried in a fluidised bed dryer, and subsequently fired, typically to 1000° C., to produce porous silica-based ceramic beads, of about 20% porosity, typically about 1 mm in diameter and 4 mm long.

(iii) The porous beads are placed in a pressure vessel, and the vessel evacuated to approximately 1 mbar (100 Pa) absolute to remove air from the pores. The vessel is then filled under vacuum with an aqueous solution of aminomethylenepentaphosphonic acid-based scale inhibitor (15% by volume of inhibitor, in distilled water containing 2000 ppm $Ca^{++}$ in the form of chloride, at pH 5), and the pressure raised to 200 atm (20 MPa). The vessel is heated to 93° C. to promote inhibitor adsorption and precipitation within the porous beads, while being kept at constant pressure, and left in this state for 24 hours. The vessel is then depressurised, drained, and cooled, and the beads removed.

(iv) The beads are then freeze-dried, and then stage (iii) is repeated to precipitate still more inhibitor in the pores. The beads are then ready for use.

The mesh cylinders 24 might be made of a variety of different materials, such as steel; clearly they must be fluid permeable, but instead of wire mesh they might comprise perforated metal plate or a wire-wound structure. They might also be of a non-metallic material. The apertures or perforations through the cylinders 24 must be small enough to prevent the particles from falling out of the annular gap 26, but are desirably not so small as to impede fluid flow significantly.

Referring now to FIG. 2 there is shown a sectional view of an alternative tubular filter 30, only a part of one side of the filter 30 being shown, the longitudinal axis of the filter 30 being indicated by the chain dotted line 31. The filter 30 includes a steel tube 32 whose bore is of diameter 45 mm, and whose walls are provided with many perforations 34. The outer surface of the tube 32 is enveloped by a tube 36 of woven fine wire mesh (for example the wires might be of diameter 0.1 mm and be 0.3 mm apart). An annular space 38 of radial width 10 mm is defined between the mesh tube 36 and an outer tube 40, and this space 38 is filled with a bed of porous silica spheres 42 of diameters between 1.5 and 2 mm. The outer tube 40 comprises twenty longitudinal steel strips 44 equally spaced around the circumference of the tube 40, and a helically-wound steel wire 46 each turn of which is welded to each strip 44. The wire 46 is of truncated wedge-shape in cross-section, and at the outer surface of the tube 40 the wire 46 is 2 mm wide and adjacent turns are separated by a gap of width 0.3 mm.

The filter 30 is of overall length 9 m; about 50 mm from each end the mesh tube 36 and the outer tube 40 terminate, and the outer tube 40 is welded to the tube 32. The projecting end portions of the tube 32 do not have any perforations 34, and define threaded joints (not shown) so one filter 30 can be securely joined to another. Hence several filters 30 can be joined end to end to make up a desired length, for example to extend through an oil-bearing stratum.

It should be appreciated that the filters 20 and 30 may differ from those described, while remaining within the scope of the invention. In particular the particles may be of a different size and shape, and the radial width of the annular gap 26 or of the annular space 38 may be different, preferably being between 5 mm and 25 mm. The particles in the gap 26 or in the space 38 may be free-flowing, or may be bound together with a binder such as a resin, as long as the resultant bonded structure remains readily fluid-permeable. Such a coherent, bonded structure may also incorporate glass fibres by way of reinforcement, and may be strong enough to be used without the outer tube 40. Such porous particles containing inhibitors may additionally be packed into the space outside the filter 20 or 30, between the filter 20, 30 and the inner surface of the liner pipe 14. The invention may also be practised using a conventional filter, by packing porous particles containing inhibitor into the space around the filter, between the filter and the inner surface of the liner pipe 14.

In the embodiments described above the tubular filters are located within the part of the oil well 10 in which the liner is perforated. Alternatively, tubular filters may be connected to the lower end of the production tubing; for example three 9 m long tubular filters of structure similar to those of FIG. 2 and of external diameter the same as the production tubing (for example 125 mm) might be joined end to end and used to form the lower end of the production tubing string.

In the embodiments described above the particles were impregnated with inhibitor materials; in use, the inhibitor materials gradually leach out of the particles into the well fluids to suppress deleterious processes such as scale formation or corrosion. Alternatively some or all of the particles might comprise an absorber material to remove dissolved components from the well fluids. For example the particles might comprise an ion exchange material which might, for example, selectively remove calcium, barium or strontium ions and replace them with sodium ions, so as to suppress scale formation. Such material may be regenerated in situ by pumping concentrated sodium chloride solution down the well. Alternatively the particles might incorporate a solid scavenger such as ferrous carbonate, to absorb hydrogen sulphide from the well fluids and so to suppress corresion.

We claim:

1. A method of treating an oil well so as to inhibit deleterious processes, said method comprising the steps of: (a) forming a multiplicity of rounded beads of an insoluble porous inorganic material with a porosity between 10% and 30%; (b) then causing a suppressing material to suppress the deleterious processes to be precipitated within the beads from an aqueous solution; (c) then installing the beads as a packed bed in a filter pack and installing said filter pack within the oil well; wherein said filter pack is fluid-permeable and comprises two generally coaxial tubular filter screens defining a region between them, the region containing the fluid permeable filter pack; further comprising injecting additional said beads into a gap outside the outermost tubular filter screen, the inner surface of the gap being defined by the outer surface of the filter and the outer surface of the gap being defined by the bore of the well.

2. A method as claimed in claim 1 wherein the beads are of silica- or alumina-based material of size in the range 0.3 mm to 5 mm.

3. A method as defined in claim 1 wherein said suppressing material is an inhibitor material selected from the group consisting of scale inhibitor and corrosion inhibitor.

4. A method of treating an oil well so as to inhibit deleterious processes, said method comprising the steps of: (a) forming a multiplicity of rounded beads of an insoluble porous inorganic material containing pores to provide a porosity between 10% and 30%; (b) then causing a water-soluble suppressing material for suppressing the deleterious processes to be precipitated from an aqueous solution and depositing said material within said pores of said beads in solid form; (c) then installing said beads as a packed bed to form a fluid permeable filter pack wherein said packed bed consists essentially of said porous beads; and (d) installing said filter pack within the oil well so that well fluids flow through said packed bed, said beads being such that said suppressing material dissolves gradually into said well fluids, thereby inhibiting said deleterious processes without structurally changing said packed bed.

5. A method as defined in claim 4 further including the step of constructing said filter pack to be comprised of two generally coaxial tubular filter screens defining a region between them, and the fluid permeable filter pack being disposed within said region.

6. A method as defined in claim 4 wherein said beads are of a size in the range of 0.3 mm to 5.0 mm and of a ceramic or oxide material based on silica or alumina.

7. A method as defined in claim 4 further including the step of subjecting said beads to an evacuation step for removing fluids from said pores prior to being contacted by said suppressing material.

8. A method as defined in claim 4 further including the step of treating said beads with a binder for binding said beads into a coherent fluid-permeable structure.

9. A method as defined in claim 4 further including the step of constructing said filter pack in the form of a tubular filter.

10. A method of treating an oil well for inhibiting inorganic scale formation, said method comprising the steps of: (a) forming a multiplicity of rounded beads of an insoluble porous ceramic material with a porosity between 10% and 30%; (b) then causing a water-soluble scale inhibiting material to be precipitated within said beads from an aqueous solution containing divalent cations; and (c) then installing said beads down hole within the oil well as a fluid permeable bed, so well fluids flow through said bed, and said scale inhibiting material dissolves gradually into said well fluids, thereby inhibiting scale deposition, and said bed of beads being structurally unchanged by this dissolution.

11. A method as defined in claim 10 wherein the divalent cations are calcium ions.

* * * * *